United States Patent [19]

Imai et al.

[11] 4,350,538

[45] Sep. 21, 1982

[54] METHOD FOR PRODUCING STEEL STRIP FOR TIN PLATE AND TIN-FREE STEEL PLATE IN VARIOUS TEMPER GRADES

[75] Inventors: Ichiro Imai, Kitakyusyushi; Takashi Furuya; Narumi Ando, both of Tokyo; Satoyuki Kitajima, Kitakyusyushi, all of Japan

[73] Assignee: Nippon Steel Corporation, Chiyodaku, Japan

[21] Appl. No.: 175,044

[22] Filed: Aug. 4, 1980

[51] Int. Cl.[3] ..... C21D 7/02; C21D 7/04

[52] U.S. Cl. ..... 148/12 D; 148/12.1

[58] Field of Search ..... 148/12.1, 12 C, 12 D, 148/12.3

[56] References Cited

U.S. PATENT DOCUMENTS

| | | | |
|---|---|---|---|
| 2,187,595 | 1/1940 | Wean | 148/12 D |
| 3,873,374 | 3/1975 | Kolts | 148/12.1 |
| 3,947,294 | 3/1976 | Asamura et al. | 148/12 D |
| 4,023,987 | 5/1977 | Nomura et al. | 148/12 D |

FOREIGN PATENT DOCUMENTS

| | | | |
|---|---|---|---|
| 55-152129 | 11/1980 | Japan | 148/12 D |

*Primary Examiner*—W. Stallard

*Attorney, Agent, or Firm*—Wenderoth, Lind & Ponack

[57] ABSTRACT

Adjustment of temper grades in steel strip for producing tin plate and tin-free steel plate in various temper grades is advantageously carried out by a method wherein the hardness of cold rolled steel strip is adjusted by continuous annealing and the temper grade is thereafter adjusted by subjecting the hardness-adjusted cold rolled steel strip to dry or wet temper rolling.

2 Claims, 6 Drawing Figures

METHOD FOR PRODUCING STEEL STRIP FOR TIN PLATE AND TIN-FREE STEEL PLATE IN VARIOUS TEMPER GRADES

BACKGROUND OF THE INVENTION

1. Field of the Invention

This invention relates to a method for the adjustment of the temper grade in steel strip for use in production of surface-treated plate, particularly tin plate and tin-free steel plate.

2. Description of the Prior Art

Conventionally, steel strip to be used for the production of surface-treated plate such as, for example, tin plate, is differentiated into various temper grades by adjusting the composition of the starting material steels and the hot rolling conditions to selectively obtain soft and hard cold rolled steel strip and further subjecting the steel strip to either a box annealing process or a continuous annealing process, depending on the temper grade desired to be obtained. This conventional process is not only complex in terms of the steelmaking operation and the hot rolling operation but also suffers from the disadvantage that, particularly in the case of high-grade temper strip, it is exceedingly difficult during the process of adding the alloying elements so that they adjust the C, N, Mn, etc. to fall accurately within their respectively prescribed ranges.

To eliminate this disadvantage, it has been suggested that the differentiation of steel strip into various temper grades might be effected by adjusting the degree of tempering during temper rolling, thus eliminating the need for addition of alloying elements in the steelmaking operation and making it possible to reduce the number of types of steel strip required.

In the adjustment of the temper grade of steel strip by temper rolling, it is possible to use wet temper rolling as a means for obtaining the high reduction rate required for the production of a high-grade temper strip. However, when this wet temper rolling is applied to the production of low-grade temper strip (soft material), there ensue the following two problems:

(1) Compared with dry rolling, there is not much generation of Lüders zones during wet temper rolling, and this necessitates a rather high reduction rate in order to avoid yield-point elongation. However, beyond the point at which the phenomenon of yield-point elongation ceases to occur, there is an increase in the temper grade due to work hardening, so that it is difficult to attain the desired low-grade temper. In continuously annealed strip, for example, dry rolling requires a reduction rate of about 1% to eliminate yield-point elongation, whereas wet rolling requires a reduction rate on the order of 3% to obtain the same effect.

(2) In wet temper rolling of steel strip such as soft steel material which inherently involves yield-point elongation, the phenomenon of unstable rolling (jumping) ascribable to the yield-point elongation behavior of the material undergoing the temper rolling occurs at rolling reduction rates of less than about 5%, making it impossible to carry out the rolling at a uniform reduction rate. It is, accordingly, difficult to obtain a low temper-grade steel strip for surface-treated plate by wet rolling at a low reduction rate.

SUMMARY OF THE INVENTION

One object of this invention is to provide a method of producing steel strip of various temper grades for use in producing surface treated steel plate, particularly tin plate and tin-free steel plate, in which the reduction rate is controlled in a rolling operation (adjustment of work hardness) selected from either wet rolling and dry rolling carried out under conditions which avoid the problems previously encountered in dry temper rolling and wet temper rolling performed at a low reduction for the production of low temper-grade steel strip, and in this way to eliminate said problems.

Another object of this invention is to solve the aforementioned problems involved in the dry temper rolling by providing a method in which the strip emanating from the continuous annealing unit is subjected to dry temper rolling on a dry high-reduction rolling mill provided with work rolls of small diameter and located following the continuous annealing unit, and in this way to make it possible to produce steel strip of all temper grades for use in production of surface-treated plate from a minimum number of types, preferably one type, of cold rolled steel strip by appropriately adjusting the annealing conditions and the reduction rate.

Yet another object of this invention is to provide a method for using wet temper rolling for the adjustment of temper grade in steel strip for use in production of surface-treated plate, which method completely precludes the phenomenon of jumping occurring when wet temper rolling is conducted at a low reduction rate, whereby stability of rolling is assured and the temper grade in the steel strip can be adjusted over a wide range through the control of the reduction rate.

DETAILED DESCRIPTION OF THE INVENTION

The present invention will be described in detail below with reference to the accompanying drawings. First, the conventional method for the adjustment of temper grade in steel strip for tin plate will be described with reference to FIG. 1.

Figure 1:
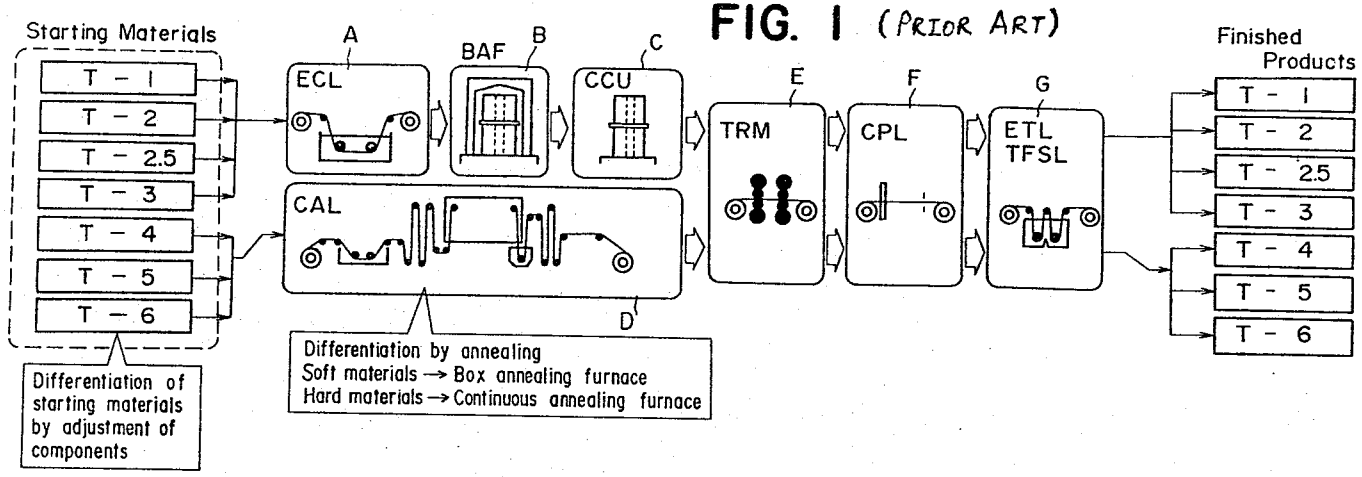
FIG. 1 (PRIOR ART)
FIG. 1 is a process flow diagram illustrating the conventional method for the adjustment of temper grade in steel strip for tin plate.

Conventionally, steel strip to be used as the material for production of tin plate has been produced, as illustrated in FIG. 1, by first adjusting the composition of the starting material steels and the hot rolling conditions to selectively obtain soft and hard cold rolled steel strip and subjecting the soft cold rolled steel strip to box annealing to obtain temper grades T-1 through T-3 and the hard cold rolled steel strip to continuous annealing to obtain temper grades T-4 through T-6, temper grades T-1 through T-6 being as defined in Japanese Industrial Standard G 3303.

In FIG. 1, A denotes an electric cleaning unit, B a box annealing furnace, C a coil cooling unit, D a continuous annealing line, E a temper rolling mill, F a coil preparation line and G an electric tin-plate line or tin-free steel line.

The fact that adjustment of the composition of the starting material is carried out in the steelmaking stage results in an increase in the total number of lots involved in the steelmaking operation, and poses a serious obstacle to the improvement of productivity through use of large converters and continuous casting. Moreover, it is exceedingly difficult to adjust the composition of the starting material for the steel strip to within their respectively prescribed ranges and, further, the addition of alloying elements increases the production cost of the steel strip.

In the method according to the present invention, the drawbacks of the conventional method for the manufacture of steel strip for use in the production of surface-treated plate, such as tin plate, are eliminated, the number of types of such steel strip can be reduced to one type and high-quality steel strip for use in the production of surface-treated plate can be produced inexpensively, efficiently and continuously by subjecting this single type of cold rolled steel strip for all temper grades to continuous annealing and then obtaining the various temper grades by controlling strip hardness through the adjustment of the reduction rate during temper rolling, at the same time, incorporating into the same line the steps for inspection and fine adjustment.

Thus, one of the features of the present invention resides in providing a method involving using temper rolling to adjust temper grades in steel strip for use in the production of surface-treated plate, which method comprises using continuous annealing to produce, from a single type of cold rolled steel strip as a starting material, cold rolled steel strip of various hardnesses ranging from "hard" to "soft" and thereafter adjusting the temper grade of the steel strip by subjecting the cold rolled steel strips of the various hardnesses to a dry or wet rolling treatment. In cases where temper-grade differentiation of the cold rolled steel strip by the continuous annealing operation proves to be complicated, continuous annealing can be carried out so as to produce only soft steel strip and steel strip with high temper grades can be produced by carrying out temper rolling at an increased reduction rate.

Figure 2:
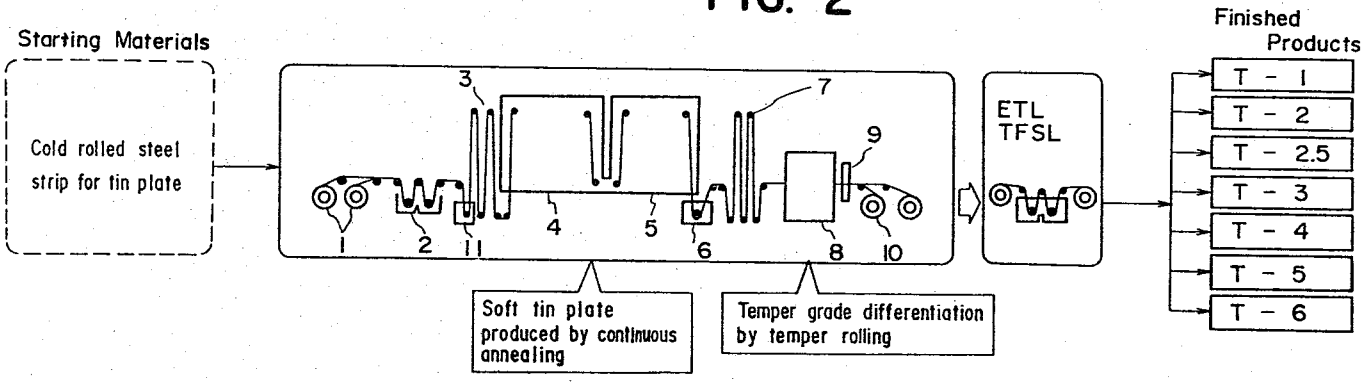
FIG. 2 is a process flow diagram illustrating the method for the adjustment of temper grade in steel strip for tin plate according to the present invention.

One preferred embodiment of this invention will be described with reference to FIG. 2.

In the flow diagram, 1 denotes a payoff reel, 2 a cleaning unit, 3 an inlet looper, 4 a continuous annealing furnace consisting of a heating zone, a soaking zone and a cooling zone, 5 an overaging furnace, 6 a cooling unit, 7 an outlet looper, 8 a temper rolling mill, 9 a unit for trimming and inspection/fine adjustment and 10 a recoiling reel. In the drawing, ETL stands for electric tin plate line and TFSL for tin-free steel plate line.

As raw materials for the production of the cold rolled strip, there may be used an aluminum-killed steel or capped steel, for example.

The cold rolled steel strip is uncoiled from the payoff reel 1, passed through the cleaning unit 2 and the inlet looper 3 into the continuous annealing furnace 4, optionally passed through the overaging furnace 5, then subjected to dry or wet rolling in the temper rolling mill 8, forwarded through unit 9 for trimming and inspection/fine adjustment and coiled on the recoiling reel 10.

The conditions for the continuous annealing (inclusive of the overaging treatment) are freely adjusted, depending on the chemical composition of the cold rolled steel strip and the temper grades required. On the one hand, for example, the cold rolled steel strip may be subjected to continuous annealing under conditions which produce a soft steel and the soft steel is hardened by wet rolling under conditions suitable for effecting the adjustment of temper grade. On the other hand, the cold rolled steel strip may be subjected to continuous annealing under conditions set to produce a somewhat hard steel and the hard steel is subjected to dry temper rolling under suitable conditions for the adjustment of temper grade. In the production of steel strip, temper grade T-3, for tin plate from an aluminum killed steel, for example, the killed steel may be annealed to a slight degree of hardness by curtailing the soaking time and the overaging time during continuous annealing and subjecting the hard annealed steel strip to temper rolling in a dry state.

The adjustment of the temper grade in steel strip for tin-free steel plate according to the present invention is accomplished by first carrying out so-called dip annealing which comprises the steps of cleaning the surface of cold rolled steel strip in cleaning unit 2, then immersing the cleaned steel strip in an immersion tank 11 filled with an aqueous solution of a metal salt such as nickel phosphate or nickel nitrate thereby causing the metal salt to adhere to the surface of the steel strip, and then subjecting the resulting steel strip to continuous annealing thereby forming a chemical treated coat on the surface of the steel strip.

A preferred embodiment of carrying out dry temper rolling according to this invention will be described below.

In temper rolling mills used for handling steel strip for surface treated plate, the work roll diameter has been at least 300 mm. In recent years, a sharp increase in the operating speed of rolling mills has necessitated adoption of work rolls having diameters of not less than 500 mm. With work rolls of such large diameters, the reduction rate in temper rolling is not allowed to exceed a level of 1.5% even under the maximum tolerable reduction force (of the order of 1200 T) above which spalling of the rolls will occur. With work rolls of such large diameters, it is extremely difficult to obtain a high reduction rate in temper rolling performed in a dry state. It is substantially impossible, therefore, to differentiate a given type of steel strip into all the temper grades required in the production of surface-treated plate so that it is impossible by dry temper rolling alone to reduce the annealed strip to obtain the number of kinds of cold rolled steel strip required.

The inventors have now acquired the knowledge that a high reduction rate can be obtained under a relatively low rolling force by dry rolling using work rolls of a small diameter, and the temper grade of steel strip to be subjected to surface treatment can be adjusted by suitably varying the reduction rate in dry temper rolling using such work rolls.

In other words, one aspect of this invention resides in effecting the differentiation of steel strip into all temper grades, T-1 through T-6, by the installation downstream of the continuous annealing line of a dry temper rolling mill provided with small diameter work rolls, namely diameters within the range of from 50 to 300 mm, and then carry out the continuous annealing under such conditions and also temper rolling at such a temper rolling reduction rate by the operation of the small-diameter dry temper rolling mill that the desired temper grade is obtained.

The reason for fixing the upper limit of the diameter of the work rolls in the present invention at 300 mm is that, when the diameter exceeds this upper limit, the maximum reduction rate obtainable is about 2%, which is not sufficient for the purpose of temper grade differentiation for all grades by the control of the reduction rate in the temper rolling. The reason for fixing the lower limit of the diameter of the work rolls at 50 mm is that the control of the reduction rate, which governs the temper grade, is difficult because a very slight change in load can greatly affect the elongation below this limit and also because the service life of the bearings is notably reduced by a decrease of the diameter below this limit.

Figure 3:
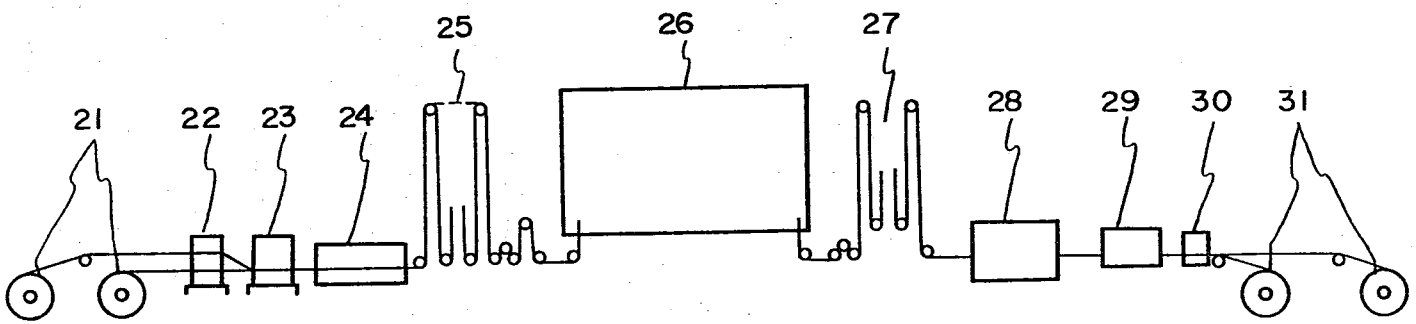
FIG. 3 is a schematic diagram illustrating other facilities for carrying out the method of this invention.

FIG. 3 illustrates one typical layout for carrying out the method of this invention.

In the diagram, 21 denotes payoff reels, 22 a cropping unit, 23 a welding machine, 24 a cleaning unit, 25 an inlet looper, 26 a continuous annealing furnace, 27 an outlet looper, 28 a small-diameter dry temper rolling mill means according to this invention, 29 a unit for inspection/fine adjustment (consisting of a tension leveler, a trimmer, an inspection apparatus, a lubricating apparatus, etc.), 30 a dividing unit and 31 recoiling reels.

Figure 4A:
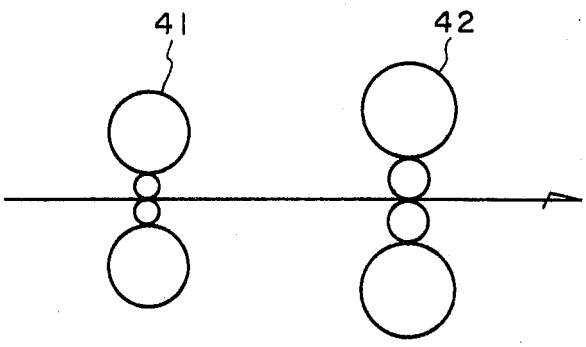
FIGS. 4*a*–4*c* are schematic diagrams illustrating embodiments of a dry temper rolling mill provided with work rolls of a small diameter according to the present invention.
Figure 4B:
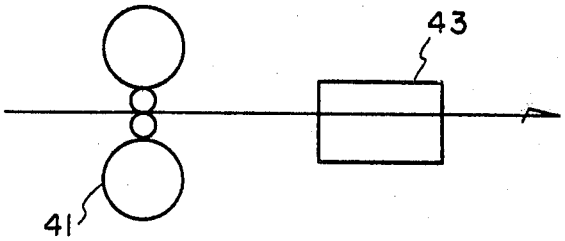
Figure 4C:
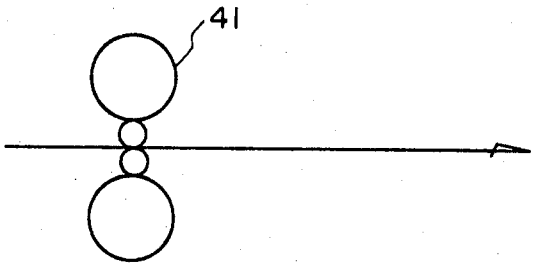

The temper rolling mill means described above may be constructed as shown in FIGS. 4*a*–4*c*. FIG. 4-*a* illustrates a mill means wherein a rolling stand 42 is installed behind the temper rolling mill 41 for correcting the shape of the thin steel strip; FIG. 4-*b* a mill means wherein a tension leveler 43 is disposed behind the temper rolling mill for correcting the shape of the thin steel strip; FIG. 4-*c* a mill means constituted by a single stand small-diameter dry rolling mill 41 capable of controlling the shape of the thin steel strip is installed.

The rolling mill 41 to be used herein may be a four-high type or a six-high type, though the type of this mill is not critical.

This manner of carrying out the dry temper rolling can be used in the method described in connection with FIG. 2 for temper rolling all of the temper grades of the strip or rolling only some of the grades of the strip and using conventional wet temper rolling for the other grades.

A preferred embodiment of carrying out wet temper rolling according to this invention will be described. This can be used in the method described in connection with FIG. 2 for temper rolling all of the temper grades of the strip or rolling only some of the grades of the strip and using conventional dry temper rolling for the other grades.

In the wet temper rolling treatment performed on steel strip to be subjected to surface treatment such as that used for tin plate, the phenomenon of unstable rolling (jumping) occurs, as previously touched upon, at low reduction rates because of small strip thickness, high hardness and high rolling speed. For this reason for low reduction rates, perfectly dry rolling is conventionally used instead of wet rolling which involves use of a rolling oil, for example.

When the temper rolling is carried out in a perfectly dry state, since the work rolls in the temper rolling mill and the steel strip under treatment come into mutual metallic contact, the coefficient of friction is abnormally high and the elongation of the steel strip during the temper rolling generally falls short of 2%. It is, therefore, extremely difficult to effect complete temper grade control (particularly in the case of steel for tin plate) of steel strip by the regulation of the reduction rate in the temper rolling.

It follows that differentiation of steel strip into strip possessing varying hardnesses from one and the same raw material could be accomplished easily if stability of rolling at low reduction rates could be secured by wet temper rolling performed on a cold rolled steel strip and, consequently, the control of grades of steel strip for use in producing surface-treated plates could be effected over a wide range by using either wet rolling where dry rolling does not suffice or using wet rolling for all reductions resulting in improved productivity, simplified operation and a markedly lowered production cost.

Through numerous experiments, the inventors have discovered that the stability of wet temper rolling involving a reduction rate of not more than 5% can be ensured by controlling the thickness of the cold rolled steel strip subjected to the rolling and the diameter of the work rolls in the temper rolling mill within respectively prescribed ranges.

Thus, still another feature of the present invention resides in making possible the differentiation of cold rolled steel strip for surface-treated plate throughout the entire range of temper grades, T-1 through T-6, by subjecting the steel strip emanating from the continuous annealing treatment to wet rolling in a temper rolling mill using work rolls of diameter D and in which the ratio of the diameter, D, to the thickness, t, of the steel strip under treatment (D/t) falls below 2000, and preferably below 1500.

According to this particular embodiment, since the wet temper rolling at a reduction ratio of not more than 5% can be stably carried out without occurrence of jumping, the temper grade of steel strip for surface-treated plates can be adjusted over the entire range of T-1 through T-6 by control of the reduction rate by wet temper rolling.

Now, working examples typifying the various embodiments of this invention described above will be cited.

Table 1 and Table 2 show working examples based on the first embodiment of this invention and Table 3 and Table 4 show working examples based on the second embodiment of the invention.

TABLE 1

| Aluminum killed, continuously cast steel | | | | | | | | | | | | |
|---|---|---|---|---|---|---|---|---|---|---|---|---|
| Components | | | | | | | Continuous annealing conditions | | Reduction rate | | Tin plated product Hardness | Temper |
| C | Si | Mn | P | S | Al | N | Soaking | Overaging | Dry | Wet | (HR30T) | grade |
| % | | | | | | | | | | | | |
| 0.006 | 0.02 | 0.12 | 0.021 | 0.011 | 0.069 | 22 | 690° C. × 25 sec | Nil | 1.1% | — | 49.5 | T-1 |
| " | " | " | " | " | " | " | " | " | — | 4.3% | 52.5 | T-2 |
| " | " | " | " | " | " | " | " | " | — | 6.0% | 55.0 | T-2.5 |
| 0.060 | 0.02 | 0.19 | 0.025 | 0.016 | 0.072 | 23 | 775° C. × 75 sec | 400° C. × 3 min | 1.0% | — | 49.0 | T-1 |
| " | " | " | " | " | " | " | 690° C. × 50 sec | 400° C. × 2 min | 1.0% | — | 53.0 | T-2 |

TABLE 1-continued

| Components | | | | | | | Aluminum killed, continuously cast steel: Continuous annealing conditions | | Reduction rate | | Tin plated product Hardness | Temper |
|---|---|---|---|---|---|---|---|---|---|---|---|---|
| C | Si | Mn | P | S | Al | N | Soaking | Overaging | Dry | Wet | (HR30T) | grade |
| " | " | " | " | " | " | " | 690° C. × 25 sec | 400° C. × 1 min | 1.0% | — | 55.0 | T-2.5 |
| " | " | " | " | " | " | " | 690° C. × 50 sec | 400° C. × 2 min | — | 3.0% | 57.0 | T-3 |
| " | " | " | " | " | " | " | 690° C. × 25 sec | 400° C. × 1 min | — | 3.7% | 61.0 | T-4 |
| " | " | " | " | " | " | " | " | " | — | 7.5% | 65.0 | T-5 |
| " | " | " | " | " | " | " | 640° C. × 20 sec | Nil | — | 5.4% | 65.0 | T-5 |
| " | " | " | " | " | " | " | " | Nil | — | 9.5% | 69.0 | T-6 |

TABLE 2

| Components | | | | | | Capped steel: Continuous annealing conditions | | Reduction rate | | Tin plated product Hardness | Temper |
|---|---|---|---|---|---|---|---|---|---|---|---|
| C | Si | Mn | P | S | N | Soaking | Overaging | Dry | Wet | (HR30T) | grade |
| % | % | % | % | % | ppm | | | | | | |
| 0.07 | 0.007 | 0.26 | 0.012 | 0.019 | 20 | 690° C. × 50 sec. | 400° C. × 2 min | 1.0% | — | 54.5 | T-2.5 |
| " | " | " | " | " | " | 690° C. × 25 sec | 400° C. × 1 min | 1.0% | — | 57.0 | T-3 |
| " | " | " | " | " | " | " | " | — | 3.0% | 61.0 | T-4 |
| " | " | " | " | " | " | 640° C. × 20 sec | Nil | — | 3.0% | 65.0 | T-5 |
| " | " | " | " | " | " | " | Nil | — | 7.0% | 69.0 | T-6 |

TABLE 3

| Components | | | | | | | Aluminum killed, continuously cast steel: Continuous annealing conditions | | Reduction | Tin plated product Hardness | Temper |
|---|---|---|---|---|---|---|---|---|---|---|---|
| C | Si | Mn | P | S | Al | N | | | | | |
| % | % | % | % | % | % | ppm | Soaking | Overaging | rate | (HR30T) | grade |
| 0.006 | 0.02 | 0.12 | 0.021 | 0.011 | 0.169 | 22 | 690° C. × 25sec | Nil | 1.0% | 49.0 | T-1 |
| " | " | " | " | " | " | " | " | Nil | 2.5% | 53.0 | T-2 |
| " | " | " | " | " | " | " | " | Nil | 3.3% | 55.0 | T-2.5 |
| 0.060 | 0.02 | 0.19 | 0.025 | 0.016 | 0.072 | 23 | 730° C. × 75sec | 400° C. × 3min | 1.0% | 49.0 | T-1 |
| " | " | " | " | " | " | " | 690° C. × 50sec | 400° C. × 2min | 1.1% | 53.0 | T-2 |
| " | " | " | " | " | " | " | 690° C. × 25sec | 400° C. × 1min | 1.1% | 55.0 | T-2.5 |
| " | " | " | " | " | " | " | 690° C. × 25sec | 400° C. × 1min | 1.9% | 57.0 | T-3 |
| " | " | " | " | " | " | " | 620° C. × 25sec | Nil | 1.2% | 61.0 | T-4 |
| " | " | " | " | " | " | " | " | Nil | 2.8% | 65.0 | T-5 |
| " | " | " | " | " | " | " | " | Nil | 4.4% | 69.0 | T-6 |

Notes:
(1) Diameter of work roll - 160 mm
(2) Temper rolling performed in dry state

TABLE 4

| Components | | | | | | Capped steel: Continuous annealing conditions | | Reduction | Tin plated product Hardness | Temper |
|---|---|---|---|---|---|---|---|---|---|---|
| C | Si | Mn | P | S | N | | | | | |
| % | % | % | % | % | ppm | Soaking | Overaging | rate | (HR30T) | grade |
| 0.07 | 0.007 | 0.26 | 0.012 | 0.019 | 20 | 690° C. × 50sec | 400° C. × 2min | 0.9% | 54.0 | T-2.5 |
| " | " | " | " | " | " | 690° C. × 25sec | 400° C. × 1min | 1.0% | 57.0 | T-3 |
| " | " | " | " | " | " | 620° C. × 25sec | Nil | 1.1% | 61.0 | T-4 |
| " | " | " | " | " | " | " | Nil | 2.7% | 65.0 | T-5 |
| " | " | " | " | " | " | " | Nil | 4.3% | 69.0 | T-6 |

Notes:
(1)Diameter of work roll - 160 mm
(2) Temper rolling performed in dry state Now, a working example of the third embodiment of this invention will be described below in conjunction with a comparative example.

A steel strip 0.2 mm in thickness (chemical composition: 0.06% of C, 0.006% of Si, 0.25% of Mn, 0.013% of P, 0.020% of S, 0.0019% of N and the balance of Fe) was subjected to continuous annealing (under conditions of 630° C. soaking temperature and 18 sec. soaking time), and subjected to wet temper rolling under varying reduction rates on a temper rolling mill provided with work rolls of a diameter of 165 mm (D/t=825) to produce steel strip of varying temper grades. The results are shown in Table 5 below. At all the reduction rates involved, the rolling was stably carried out without occurrence of jumping.

TABLE 5

| Reduction rate | Reduction load | Tension on inlet side | Tension on outlet side | Rolling speed |
|---|---|---|---|---|
| 0.9% | 49kg/mm$^2$ | 5kg/mm$^2$ | 10kg/mm$^2$ | 100mpm |
| 1.3 | 54 | " | " | " |
| 2.1 | 64 | " | " | " |
| 3.1 | 75 | " | " | " |
| 4.2 | 87 | " | " | " |
| 5.5 | 105 | " | " | " |
| 7.3 | 126 | " | " | " |

By way of comparison, the aforementioned steel strip was subjected to wet temper rolling on a temper rolling mill provided with work rolls 480 mm in diameter (D/t=2400). During rolling, jumping occurred when the reduction rate was within the range of from 0 to 6.5%, making it impossible to effect the adjustment of temper grade in steel strip by the control of the reduction rate.

What is claimed is:

1. A method for adjustment of temper grade in steel strip for use in production of surface-treated plate, particularly tin plate and tin-free steel plate, by temper rolling, which method comprises subjecting a cold rolled strip of low-carbon steel to continuous annealing and subsequently effecting temper-grade differentiation of the steel strip over the entire range of temper grades T-1 through T-6 by subjecting the steel strip to dry temper rolling for obtaining at least some of the temper grades, the dry temper rolling being carried out with a temper rolling mill provided with work rolls 50 to 300 mm in diameter, and subjecting the steel strip to wet temper rolling for obtaining any temper grades not obtained by the dry temper rolling.

2. A method for adjustment of temper grade in steel strip for use in production of surface-treated plate, particularly tin plate and tin-free steel plate, by temper rolling, which method comprises subjecting a cold rolled strip of low-carbon steel to continuous annealing and subsequently effecting temper-grade differentiation of the steel strip over the entire range of temper grades T-1 through T-6 by subjecting the steel strip to wet temper rolling for obtaining at least some of the temper grades, the wet temper rolling being carried out with a temper rolling mill provided with work rolls having a ratio of the diameter D of the work rolls to the thickness t of the cold rolled steel strip (D/t) below 2000, and subjecting the steel strip to dry temper rolling for obtaining any temper grades not obtained by the wet temper rolling.

* * * * *